US008941300B2

(12) United States Patent
Ansems et al.

(10) Patent No.: US 8,941,300 B2
(45) Date of Patent: Jan. 27, 2015

(54) ELECTRIC LAMP

(75) Inventors: Johannes P. M. Ansems, Hulsel (NL); Antonius A. M. Marinus, Eindhoven (NL); Vincent S. D. Gielen, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 431 days.

(21) Appl. No.: 13/320,363

(22) PCT Filed: May 6, 2010

(86) PCT No.: PCT/IB2010/051996

§ 371 (c)(1),
(2), (4) Date: Nov. 14, 2011

(87) PCT Pub. No.: WO2010/131166

PCT Pub. Date: Nov. 18, 2010

(65) Prior Publication Data

US 2012/0061699 A1 Mar. 15, 2012

(30) Foreign Application Priority Data

May 15, 2009 (EP) ..... 09160399
Sep. 3, 2009 (EP) ..... 09169384

(51) Int. Cl.

| | |
|---|---|
| ***F21V 29/00*** | (2006.01) |
| ***F21K 99/00*** | (2010.01) |
| ***F21V 7/04*** | (2006.01) |
| ***F21V 3/02*** | (2006.01) |
| *F21Y 101/02* | (2006.01) |

(52) U.S. Cl.

CPC ..... *F21K 9/135* (2013.01); *F21V 29/2256* (2013.01); *F21K 9/56* (2013.01); *F21V 7/04* (2013.01); *F21V 3/02* (2013.01); *F21V 29/004* (2013.01); *F21Y 2101/02* (2013.01)

USPC ..... 313/512; 362/84

(58) Field of Classification Search

CPC ..... F21K 9/135; F21K 9/56; F21V 3/02; F21V 29/004; F21V 29/2256; F21Y 2101/02

USPC ..... 313/512

See application file for complete search history.

(56) References Cited

U.S. PATENT DOCUMENTS

2009/0059559 A1* 3/2009 Pabst et al. ..... 362/84

FOREIGN PATENT DOCUMENTS

| | | | |
|---|---|---|---|
| DE | 202008017116 | U1 | 4/2009 |
| DE | 102007040444 | A1 | 5/2009 |
| JP | 2004296245 | A | 10/2004 |

(Continued)

*Primary Examiner* — Andrew Coughlin
(74) *Attorney, Agent, or Firm* — Yuliya Mathis

(57) ABSTRACT

An electric lamp (1) comprising a socket (2), a lamp bulb (4) mounted on the socket, in which bulb at least one semiconductor light source (5) is arranged. Cooling means (6) comprise at least two facing cooling fins (7,8) which are separated by at least one spacing (9). Said spacing being open to the environment and extending from the heart of the lamp bulb to the outer surface of the bulb. The lamp comprises a light redistributing, light transmittable wall (13) for redistributing light; optionally said light redistributing wall comprises separate, discernable wall parts (14,15). For example, each discernable bulb part is shaped like a surface of a half prolate or half oblate ellipse. Thus, a desired double beam or homogeneous, omni-directional light distribution is obtainable.

15 Claims, 9 Drawing Sheets

(56) References Cited

FOREIGN PATENT DOCUMENTS

| | | | |
|---|---|---|---|
| JP | 2009016058 | A | 1/2009 |
| WO | 2010058325 | A1 | 5/2010 |
| WO | 2010067274 | A1 | 6/2010 |

* cited by examiner

ELECTRIC LAMP

FIELD OF THE INVENTION

The invention relates to an electric lamp comprising:

a socket for mounting the lamp along an insertion direction in a lamp holder, a lamp bulb mounted on the socket, in which bulb at least one semiconductor light source is arranged, cooling means for cooling the lamp during operation, the cooling means comprising at least two facing cooling fins which are separated by at least one spacing.

BACKGROUND OF THE INVENTION

Such an electric lamp is known from WO2008154172. In the known lamp a semiconductor light source, i.e. a plurality of LEDs, is mounted on one of the cooling fins. Both the light source and the cooling fins are arranged in a lamp bulb, the lamp bulb having a lamp shell with a shape according to the lamp bulb of a common incandescent general light source (GLS). The known lamp has the disadvantage that cooling of the LEDs is not effective as the cooling fins are arranged in a fully closed lamp shell. Once the filling of the bulb has been warmed up by the heat generating LEDs inside the bulb, transport of heat from inside the bulb to the exterior has to occur through the lamp shell, said shell generally not being a good heat conductor. In the known lamp, to enhance heat flow from the LEDs to the ambient atmosphere, the lamp is provided with a heat conductor inside the shell, causing the lamp to be of a relatively complex construction. In the known lamp the shell is filled with a liquid or a gel to counteract the detrimental effect of the shell on heat conduction, but this results in the lamp having the additional disadvantage of being relatively heavy. Furthermore, as the heat still has to be transported through the relatively poorly heat conducting wall of the shell, the known lamp still has a relatively high temperature inside the bulb, causing the lamp to have a relatively low efficiency as the operation of the LEDs at higher temperatures is relatively inefficient.

SUMMARY OF THE INVENTION

It is an object of the invention to counteract at least one of the disadvantages of the known electric lamp. To achieve this the electric lamp as described in the opening paragraph has the additional features of:

said spacing being open, the spacing dividing the lamp bulb into at least two discernable bulb parts, a lamp axis extending along the insertion direction through a central end of the socket, through said spacing, and through a (virtual) central extreme of the bulb most remote from the socket, the lamp comprising a light redistributing, light transmittable wall for redistributing light originating from the light source so as to obtain a desired light distribution during operation of the lamp.

The term "open spacing" in this respect means that the spacing is open to the environment to enable an exchange of environmental air with convection/free flowing air present in the spacing as a result of heat generated by the light source(s) during operation. The feature of the lamp axis extending through the open spacing causes the open spacing to have a relatively large dimension and thus extend over a relatively large fraction of the lamp bulb. Hence, the cooling capacity of the cooling fins is enhanced. The term "discernable bulb compartment" in this respect means that the lamp bulb is divided into bulb parts, which bulb parts may be mutually separated, closed compartments, or mutually separated compartments which are open to the exterior, or mutually separated compartments which are interconnected via ducts. Because of the spacing, the light distribution (beam characteristics) of the lamp is affected. The light redistributing, light transmittable wall for redistributing light having an original light distribution and originating from the light source so as to obtain a desired light distribution during operation of the lamp can correct that effect. Said light redistributing, light transmittable wall may be different for each respective, discernable compartment, thus causing the lamp to be relatively flexible in realizing a desired light distribution. The redistributing, light transmittable wall is capable of modifying the original light distribution into various, other light distributions, for example, a double narrow beam or a substantially homogeneous, almost omnidirectional light distribution. The double narrow beam light distribution exemplifies the light distribution of a spot light with, for example, two relatively narrow, round beams emitted in two opposite directions, for example at 160-200 degrees with respect to each other, each having a beam width having an apex angle of about 30 degrees. A homogeneous omnidirectional light distribution means that in the far field, i.e. at relatively large distances from the electric lamp, for example at least 50 cm, the measured light intensity is relatively homogeneous. For example, the maximum and minimum measured light intensity differs at the most by 35% within a space angle of about 300 degrees around the lamp bulb, thus being about the same as the light distribution as generated by a standard GLS. Other light distributions are envisaged, for example two oppositely directed elongated beams, or a light distribution according to a common flood light, i.e. a homogeneous light distribution within a space angle of about 160 or 180 degrees. The cooling fins facing one another include cooling fins that may be positioned in a somewhat shifted and/or angled position with respect to each other.

Said desired light distributions are obtainable via various means provided to or present in or at the light distributing wall. Therefore, in an embodiment, preferably said wall comprises at least one feature chosen from the group consisting of:

a (remote) phosphor;

a reflective means;

a diffusing means;

a shape deviating essentially from a part of a sphere.

Said (remote) phosphor provides the lamp with the advantage of being both a diffuser and a means of changing the spectrum of the light as emitted by the light sources. The phosphor, for example, is a UV- and/or blue-absorbing and subsequently green, yellow, orange, or red emitting polycrystalline powder or glass material. Said reflective means, for example, is a coating which, for example, could be provided in a pattern. Favorable patterns of said coating comprise a strip extending along the lamp axis across the bulb outer surface or a circle positioned opposite to the light source on the bulb outer surface. The light distributing wall provided with such a pattern causes the lamp to have an almost omnidirectional light distribution, for example in the case of two LEDs facing away from each other in directions perpendicular to the lamp axis. A similar effect applies to the diffusing means, but then light is not reflected but scattered by and transmitted through the diffusing means. The diffusing means for example may be a diffusive powder coating on the wall or a diffusing foil or the wall may be made of milky glass.

In the case of light distribution means being of a shape deviating essentially from a part of a sphere, light is redistributed as a result of refraction. It is possible that said light transmittable wall is part of the lamp bulb, and/or part of an inner bulb arranged inside the lamp bulb, and/or comprised as a part in the light source. Light from the light source that is incident on said transmittable wall at different locations and at different angles will be refracted differently, depending on the angle of incidence of the light on said wall. Hence, the light distribution can be controlled by the design and/or shape of the wall.

It is not a prerequisite that said wall be formed in one integral part; it could alternatively be a wall comprising at least two, non-integral/essentially separate wall parts, thus providing the lamp with more freedom of design and hence enabling advantageous technical features to be applied to the lamp. For example, in an embodiment, the electric lamp is characterized in that each PCB together with a respective bulb part form a respective discernable lamp bulb compartment. It is thus enabled to associate a bulb part with a respective light source, causing the lamp to be even more flexible in realizing a desired light distribution. In an embodiment in which the electric lamp according to the invention indeed is characterized in that in each bulb compartment at least one respective semiconductor light source is arranged, each bulb part is enabled to generate its respective light distribution. For example, it is thus possible to make the electric lamp generate light on one side having a seemingly lambertian light distribution, leading to a hemispherical, almost uniform light distribution, while on the opposite side, i.e. the opposite hemisphere, a light distribution resembling a spot light is generated by the lamp.

In an embodiment the electric lamp is characterized in that the light source is mounted on a respective PCB which is integral with a respective cooling fin. Thus, efficient and effective cooling of the semiconductor light sources is obtained. Preferably, each light source and each respective PCB is arranged in a respective bulb part, causing the lamp to have the advantage that the light sources are mutually independently controlled. More preferably, the bulb parts are arranged so as to be mutually mirror symmetrical with respect to a plane P extending in between the PCBs. For example, an embodiment of the electric lamp is characterized in that each discernable bulb part is shaped like a surface of a half prolate ellipse having two equal radii and one deviating radius, the spacing extending through the two radii of the ellipse that are equal, so that the lamp parts are mirrored with respect to the spacing. The two halves of the prolate ellipse cause the lamp to have a substantially homogeneous, almost omnidirectional light distribution during operation. In an alternative embodiment the electric lamp is characterized in that each discernable bulb part is shaped like a surface of a half oblate ellipse having two equal radii and one deviating radius, the spacing extending through the two radii of the ellipse that are equal. This causes the lamp to have double beam light characteristics, the beams pointing away from each other at an angle of about 180°.

An embodiment of the electric lamp is characterized in that the spacing has a width in the range of 3 mm to 20 mm. If the spacing has a width of less than 3 mm the cooling efficiency of the cooling fins is decreased because at smaller widths of said spacing the natural air flow through the spacing due to heat convection is hampered. The decreased cooling efficiency of the cooling fins might result in the LEDs becoming relatively hot, thus decreasing the efficiency of the lamp. If the width of said spacing becomes more than 20 mm a disturbing effect of the width on the light distribution becomes apparent, thus decreasing the quality of the lamp. Interconnecting the two discernable lamp bulb compartments via at least one bridge which bridges the spacing and which does not effectively close the spacing, i.e. the air flow due to convection is not significantly decreased, does not significantly influence the cooling efficiency of the cooling fins. Said bridges make the lamp more robust and thus better capable to withstand mechanical load, for example mechanical load that occurs in handling the lamp, for example during manufacturing or mounting.

An embodiment of the electric lamp according to the invention is characterized in that the lamp bulb essentially has a spherical shape. The lamp then has a shape which closely resembles the shape of an ordinary GLS, and replacement of said GLS lamp by the electric lamp of the invention in existing luminaries/fixtures designed for GLS lamps is convenient.

BRIEF DESCRIPTION OF THE DRAWINGS

The invention now will be elucidated further by means of the drawings in which.

DETAILED DESCRIPTION OF EMBODIMENTS

Figure 1A:
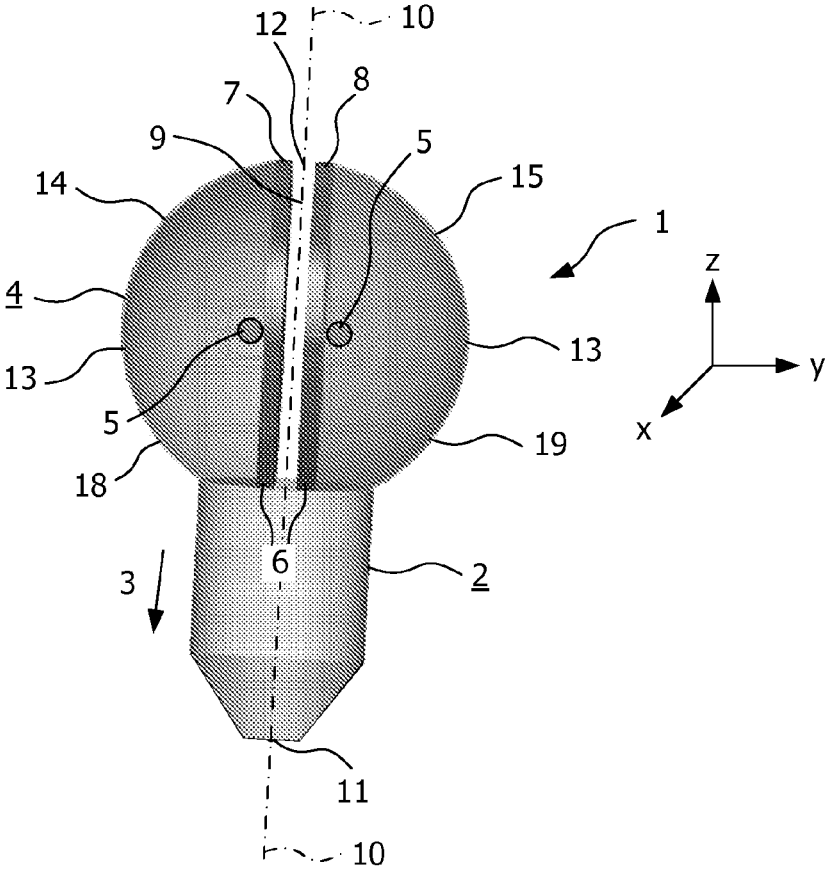
FIG. 1A shows a first embodiment of the lamp according to the invention.

For reference orientation, a coordinate symbol with x,y,z-axes is added to the drawing.

FIG. 1A shows an electric lamp 1 comprising a socket 2 for mounting the lamp along an insertion direction 3 in a lamp holder. A lamp bulb 4 is mounted on the socket, in which bulb 4 at least one semiconductor light source 5 is arranged; in the case of FIG. 1A, two pairs of LEDs are arranged in the bulb. In the Figure, the lamp bulb is made of polycarbonate, but alternatively can be made of glass or any other light transmittable solid material, for example PMMA. Cooling means 6 for cooling the lamp during operation are provided, the cooling means comprising at least two facing cooling fins 7,8 which are separated by a spacing 9, the spacing being 8 mm. Said spacing is in open communication with the external environment of the lamp. The light source is mounted on a PCB which simultaneously acts as the cooling fin. A lamp axis 10 extends along the insertion direction through a central end 11 of the socket, through said spacing, and through a (virtual) central extreme 12 of the bulb that is most remote from the socket. The lamp comprises a light redistributing, light transmittable wall 13, comprising two halves 14, 15, for redistributing light originating from the light source, i.e. a LED in each of two bulb halves 18,19 of the lamp bulb 4, so as to obtain a desired light distribution during operation of the lamp.

Figure 1B:
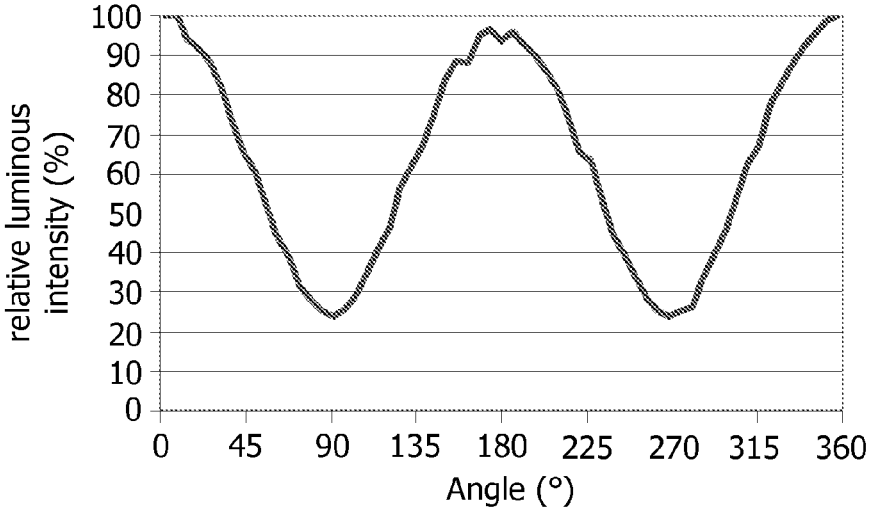
FIG. 1B shows a graph of the relative luminous intensity in annular direction around the lamp axis of the lamp of FIG. 1A.

FIG. 1B shows a graph of the relative luminous intensity in annular direction around the lamp axis 13, i.e. in the z-direction, of the lamp of FIG. 1A. The relative luminous intensity exhibits a large spread, with minima in intensity at 90° and 270°, i.e. in a direction x perpendicular to the plane of the drawing, and with maxima at 0° and 180°, i.e. in the direction y in the plane of the drawing.

Figure 1C:
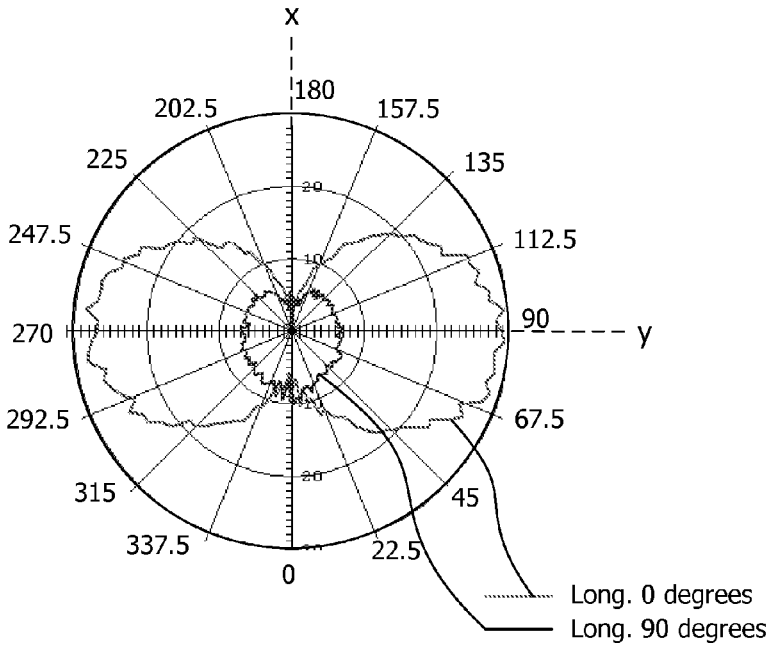
FIG. 1C shows a polar plot of the far field luminous intensity both in the directions along and transverse to the lamp axis of the lamp of FIG. 1A.

FIG. 1C shows the same luminosity intensity distribution, but represented here as a polar plot of the far field luminous intensity in the x,y-plane.

Figure 2A:
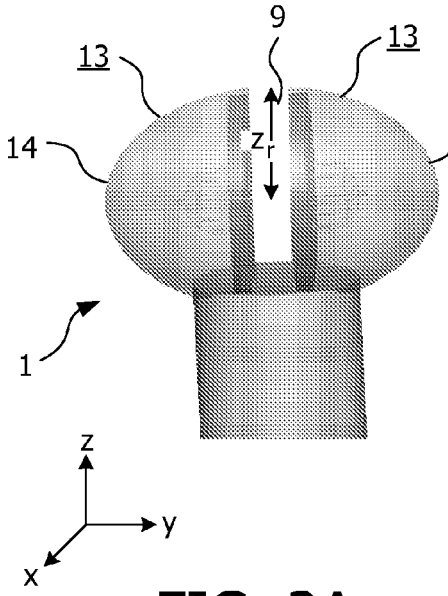
FIGS. 2A-D show Figures analogous to FIGS. 1A-C for a second embodiment of the lamp according to the invention.
Figure 2B:
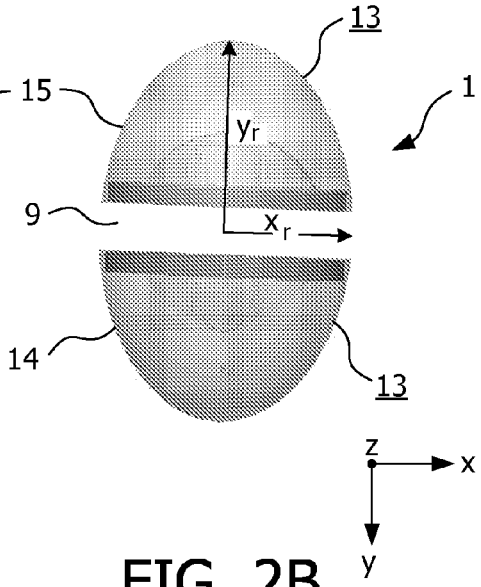
Figure 2C:
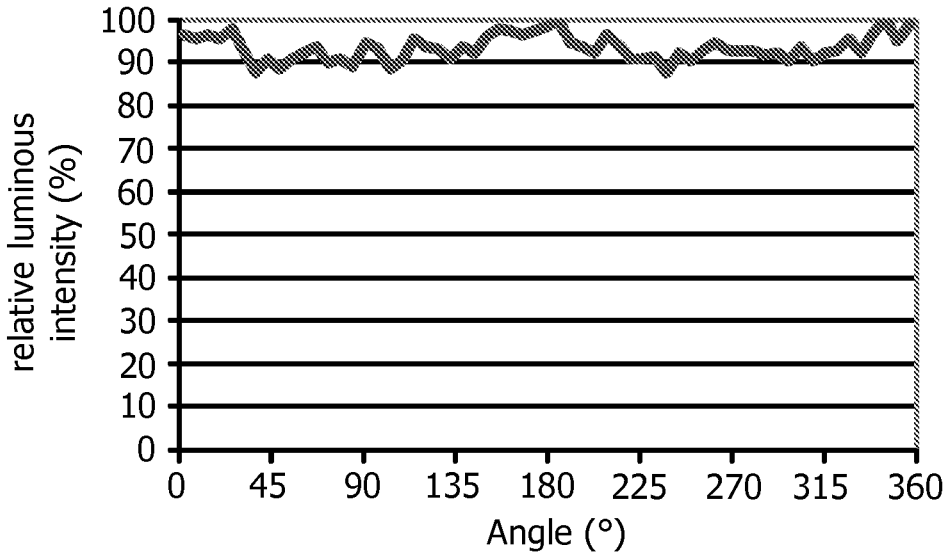
Figure 2D:
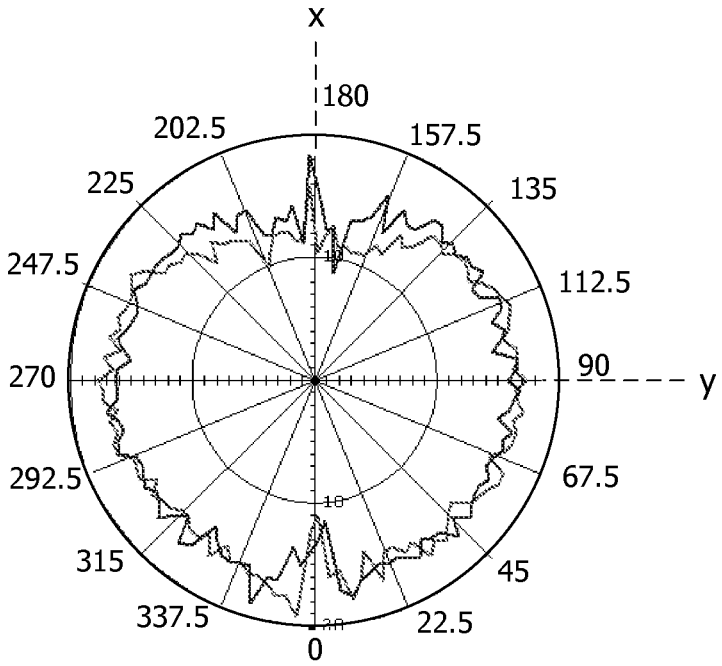

FIGS. 2A-D show Figures analogous to FIGS. 1A-C for a second embodiment of the lamp according to the invention. In FIGS. 2A and 2B the light transmittable wall 13 of the lamp 1 has an elliptical shape, i.e. is composed of two halves 14, 15 of a prolate ellipse having two equal radii $x_r$ and $z_r$ in the x-direction and in the z-direction, respectively, and one deviating radius $y_r$ in the y-direction, $y_r$ being 1.5 times as large as $x_r$ and $z_r$. The spacing 9, being 18 mm in width, extends through the two equal radii $x_r$ and $z_r$ of the ellipse. As shown in FIGS. 2C and 2D the luminosity intensity distribution obtained by the lamp of FIG. 2A is significantly influenced by the shape of the transmittable, light redistributing wall. Due to the shape of said wall, the annular and far field luminosity intensity distribution exhibit only a very limited spread in intensity, being less than 10%.

Figure 3A:
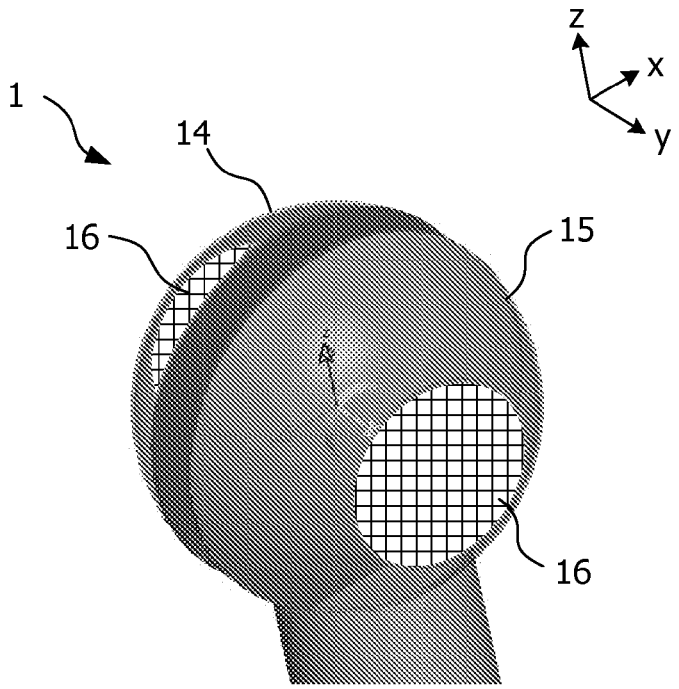
FIGS. 3A-C show Figures analogous to FIGS. 1A-C for a third embodiment of the lamp according to the invention.
Figure 3B:
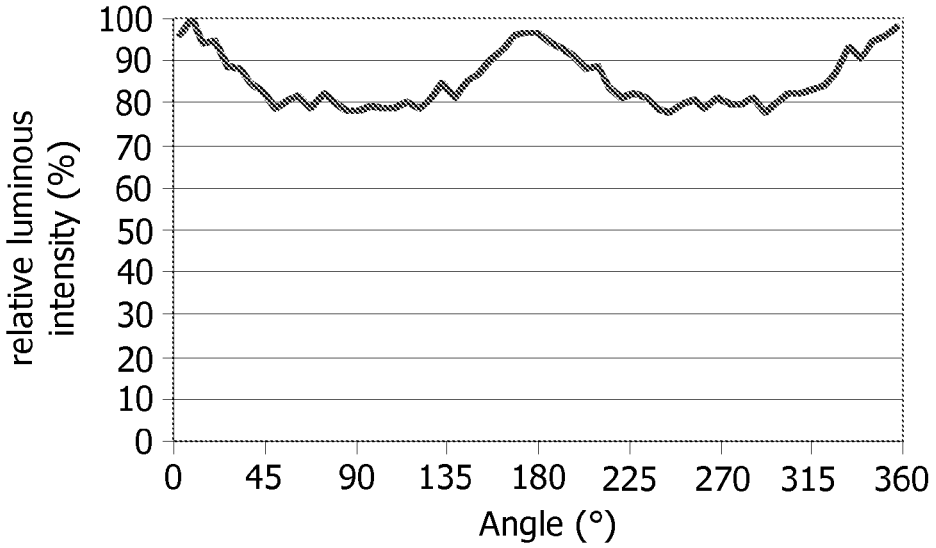
Figure 3C:
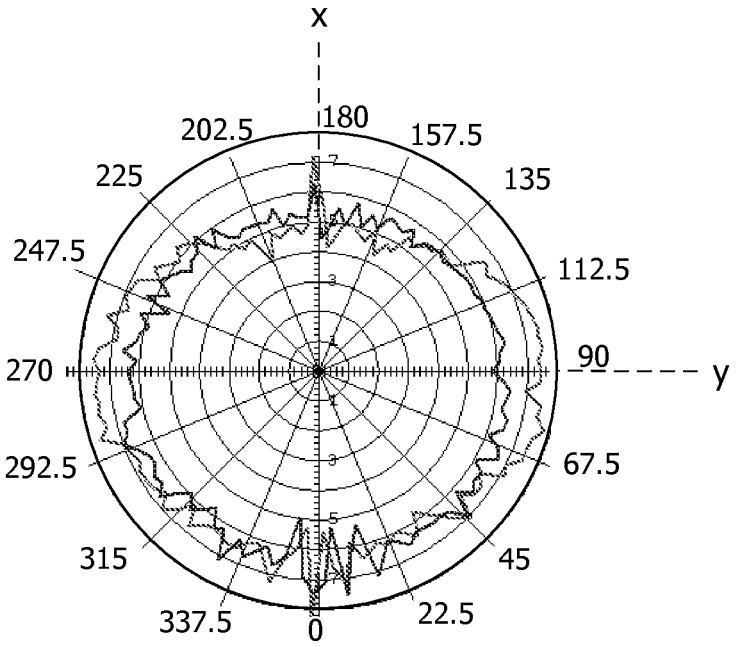

FIGS. 3A-C are analogous to FIGS. 1A-C for a third embodiment of the lamp 1 according to the invention. In FIG. 3A a diffusely reflective layer 16 is provided on each of the two halves 14, 15 of the transmittable, light redistributing wall of the lamp in a circular pattern around the y-axis direction. The overall lamp bulb is essentially a circular sphere, i.e. the same bulb shape as the lamp bulb of the lamp of FIG. 1A. The effect of the reflective layer pattern 16 on the annular and far field luminosity intensity distribution is shown in FIGS. 3B and 3C, i.e. the luminous intensity shows a relatively small spread, i.e. about 20%, compared to the luminous intensity distribution obtained by the lamp of FIG. 1A.

Figure 4A:
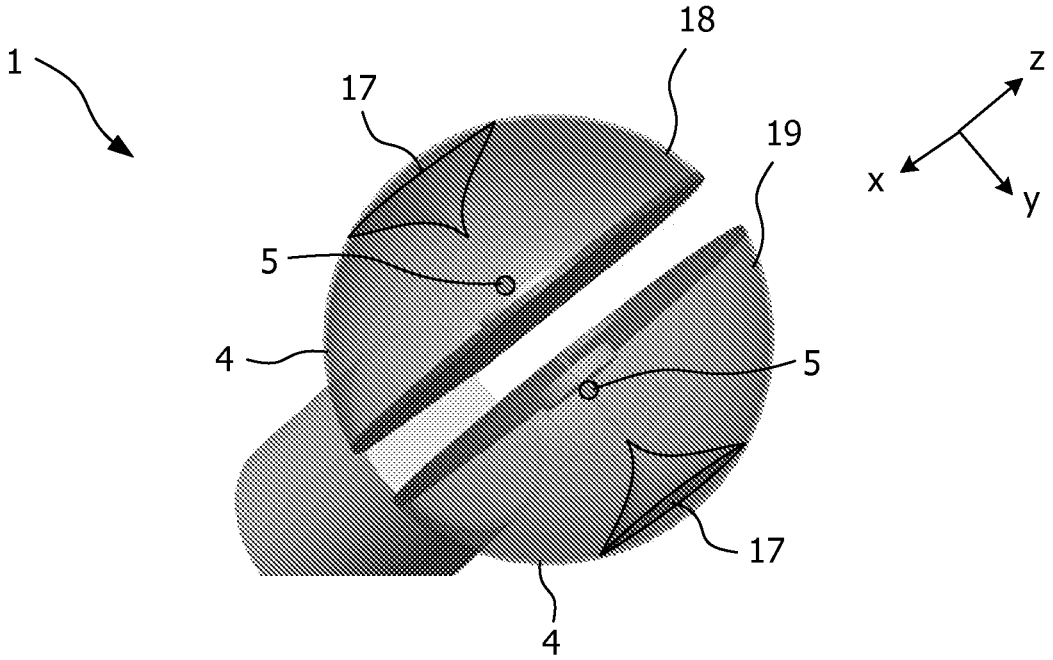
FIGS. 4A-C show Figures analogous to FIGS. 1A-C for a fourth embodiment of the lamp according to the invention.
Figure 4B:
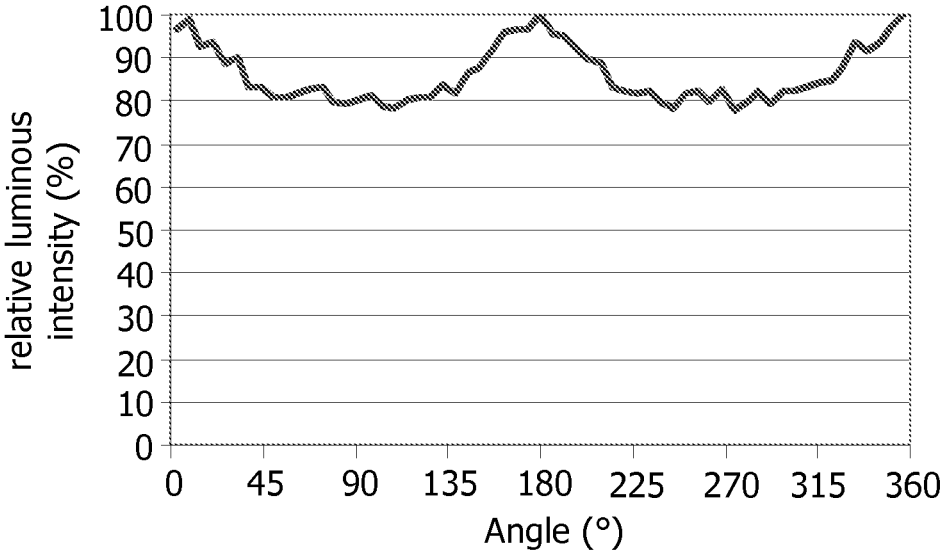
Figure 4C:
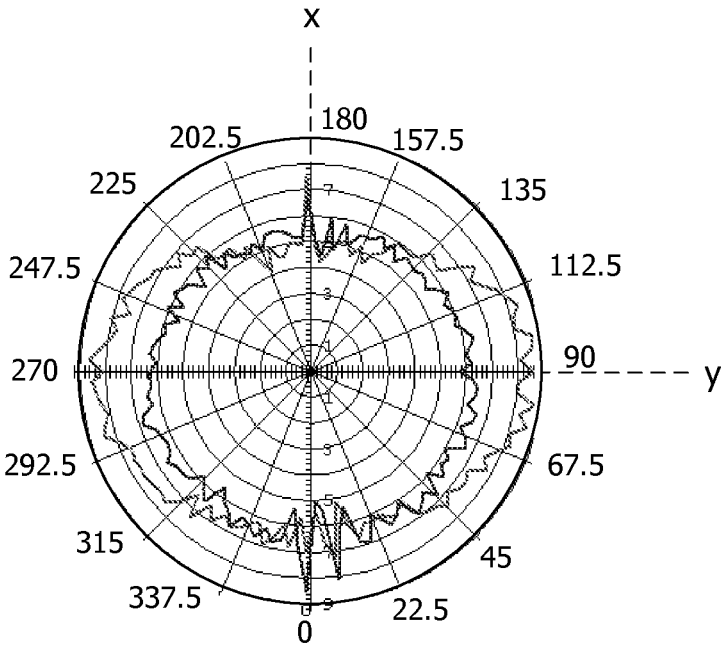

FIGS. 4A-C show Figures analogous to FIGS. 1A-C for a fourth embodiment of the lamp 1 according to the invention. In FIG. 4A a white, horn-shaped reflector 17 is provided in each of the two halves 18, 19 of the lamp bulb 4. The horn-shaped reflector has a virtual, annular circular opening around the y-axis direction, the light source 5 being arranged on the y-axis. The overall lamp bulb is essentially a circular sphere, i.e. the same bulb shape as the lamp bulb of the lamp of FIG. 1A. The effect of the reflective horn-shaped reflector 17 on the annular and far field luminosity intensity distribution is shown in FIGS. 4B and 4C, i.e. the luminous intensity showing a relatively small spread, i.e. about 20%, compared to the luminous intensity distribution obtained by the lamp of FIG. 1A.

Figure 5A:
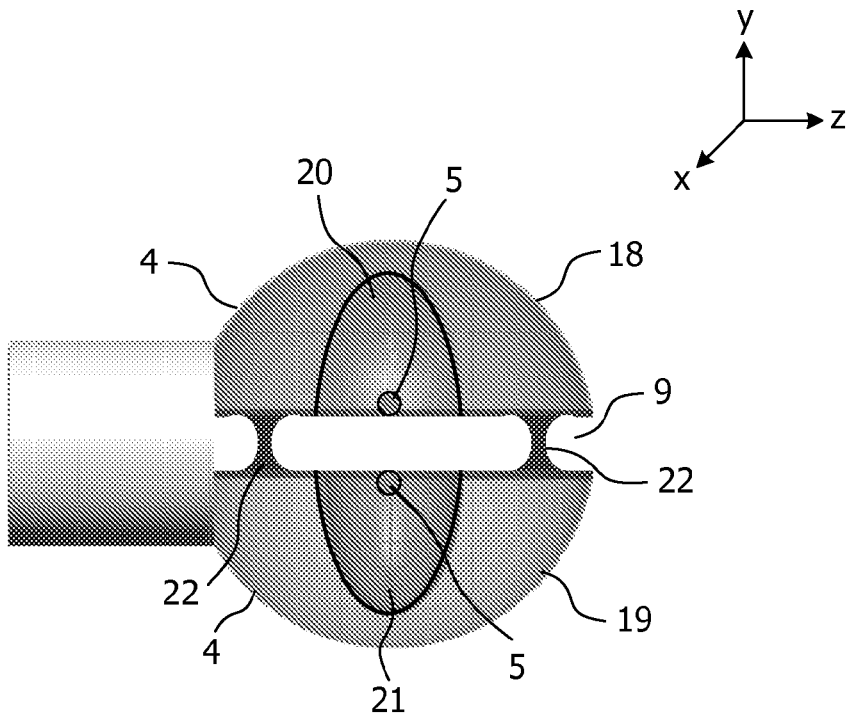
FIGS. 5A-C show Figures analogous to FIGS. 1A-C for a fifth embodiment of the lamp according to the invention.
Figure 5B:
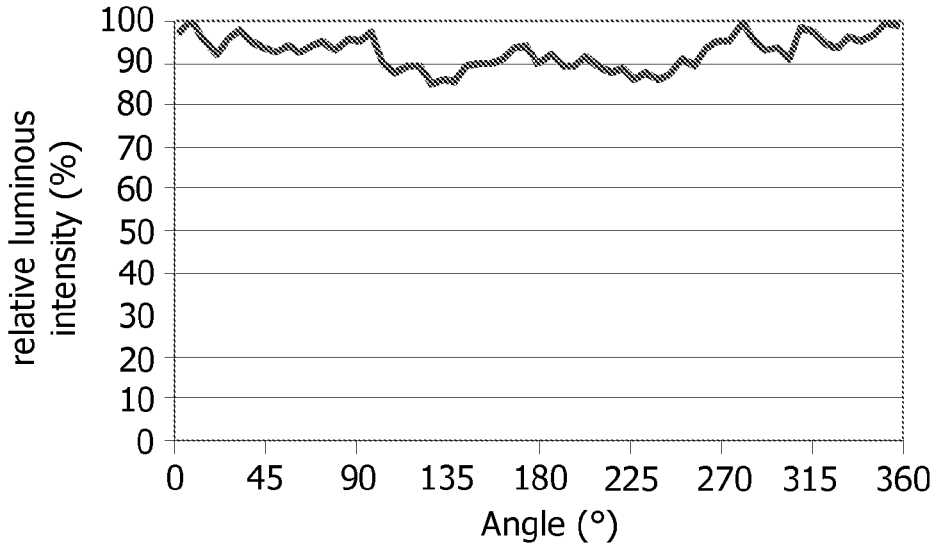
Figure 5C:
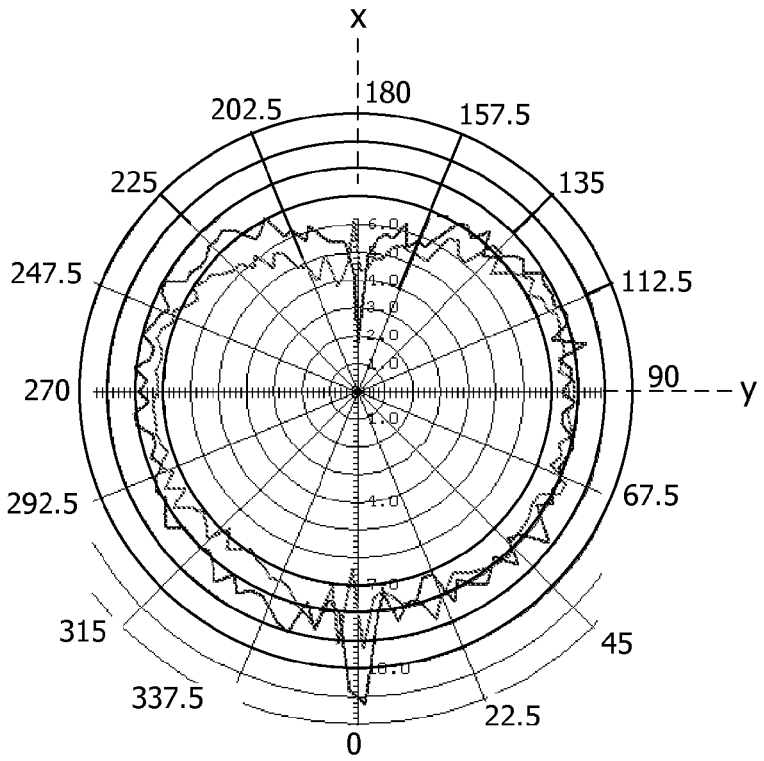

FIGS. 5A-C show Figures analogous to FIGS. 1A-C for a fifth embodiment of the lamp according to the invention. In FIG. 5A, in each of the two bulb halves 18, 19 of the lamp bulb 4 a prolate elliptical inner bulb half 20, 21 is provided. These two inner bulb halves 20,21 of a prolate ellipse having two equal radii $x_r$ and $z_r$ in the x-direction and in the z-direction, respectively, and one deviating radius $y_r$ in the y-direction, $y_r$ being 1.5 times as large as $x_r$ and $z_r$. The light source 5, being one LED in each of the inner bulb halves, is arranged on the y-axis. The spacing 9 extends through the two radii $x_r$ and $z_r$ of the ellipse that are equal. The overall lamp bulb is essentially a circular sphere, i.e. the same bulb shape as the lamp bulb of the lamp of FIG. 1A. In this lamp the lamp bulb 4 is strengthened in that bridges 22 are provided that interconnect the two bulb halves 18,19 by bridging the spacing 9. The effect of the two inner elliptical bulb halves 20,21 on the annular and far field luminosity intensity distribution is shown in FIGS. 5B and 5C, i.e. the luminous intensity showing a relatively small spread, i.e. about 15%, compared to the luminous intensity distribution obtained by the lamp of FIG. 1A.

Figure 6:
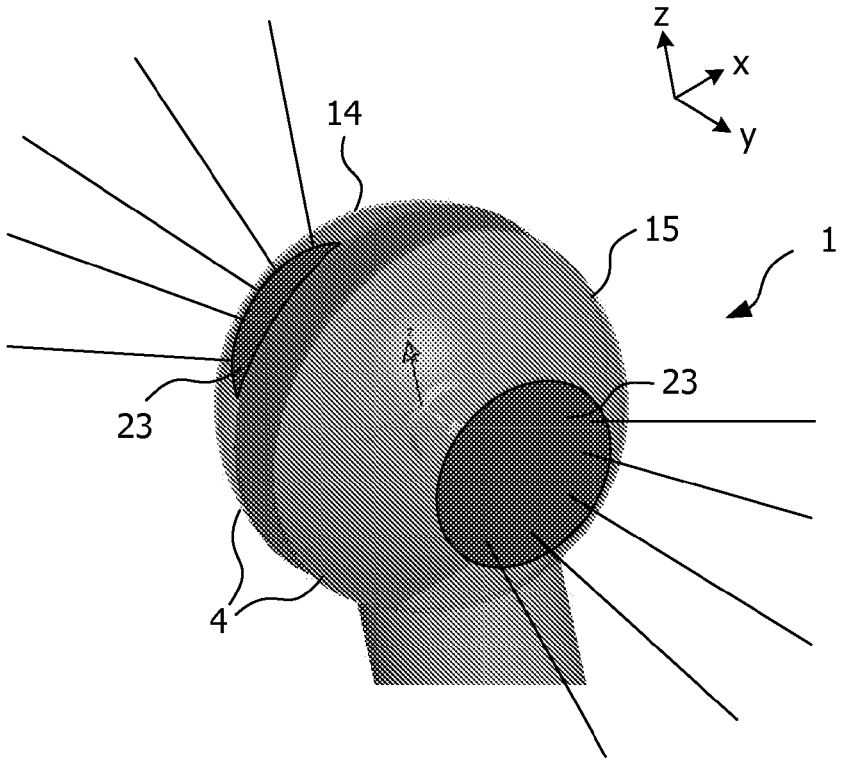
FIG. 6 shows a sixth embodiment of the lamp according to the invention.

FIG. 6 shows a sixth embodiment of the lamp 1 according to the invention. In FIG. 6 an optical open window 23 is provided on each of the two halves 14, 15 of the transmittable, light redistributing wall 4 of the lamp 1 in a circular pattern around the y-axis direction. The remainder of the wall is coated with a diffusely reflective layer. The overall lamp bulb is essentially a circular sphere corresponding to the shape of a general GLS bulb, and having the same bulb shape as the lamp bulb of the lamp of FIG. 1A. The optical open window 23 causes the lamp to have a double beam light distribution pattern in the annular direction around the z-axis and as the far field luminosity intensity distribution.

Figure 7:
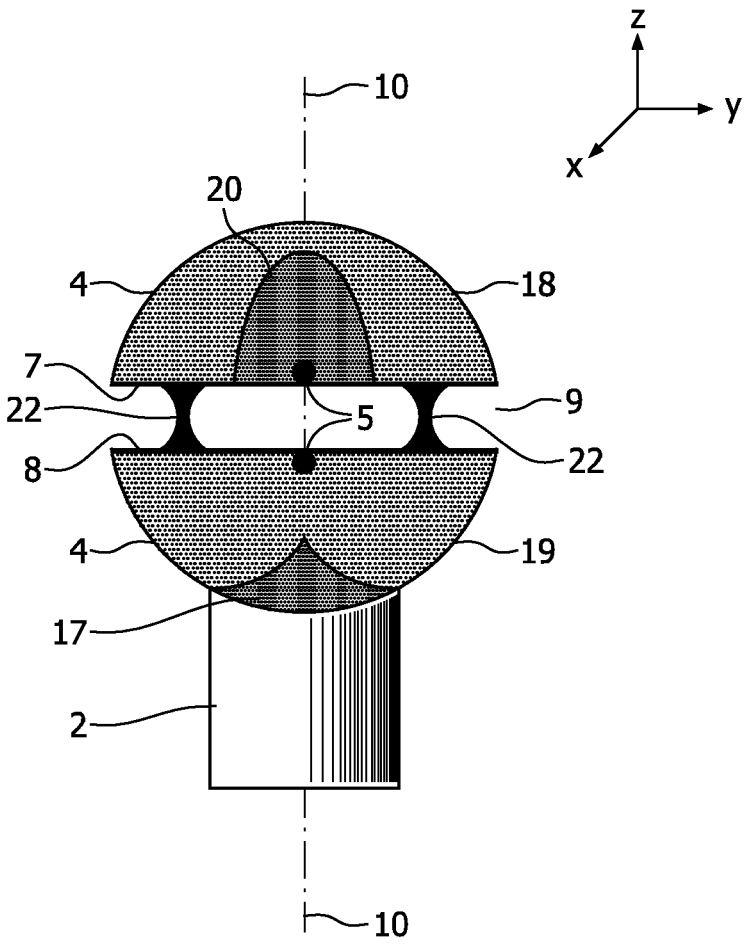
FIG. 7 shows a seventh embodiment of the lamp according to the invention.

The embodiment shown in FIG. 7 has a spacing 9 extending transversely to the lamp axis 10. Two discernable bulb parts 18,19 each form a half bulb of the lamp bulb 4, and are interconnected via three ducts in bridges 22 (only two bridges are shown). The bridges are evenly distributed over the spacing. In one bulb part 18 a prolate elliptical inner bulb 20 is provided, redistributing light originating from four LEDs 5 within said inner bulb 20, which LEDs are provided on PCB 7. In the other bulb part 19, four LEDs 5 are present which are mounted on PCB 8, together with a horn shaped reflector 17. The PCBs 7 and 8 simultaneously act as cooling fins. The horn-shaped reflector 17 has a maximal cross section transverse to the axis 10 that is of about the same dimension as a cross section transverse to the axis of socket 2. Said horn-shaped reflector thus not only effectively shields socket 2 from light radiation originating from the LEDs 5 to counteract loss of light during operation of the lamp, but also redistributes said light into a desired beam.

The invention claimed is:

1. An Electric lamp comprising:

a socket for mounting the lamp along an insertion direction in a lamp holder, a lamp bulb having a first bulb half and a second bulb half mounted on the socket, each of the first and second bulb half including at least one semiconductor light source, a first and a second cooling fin in facing relationship for cooling the lamp during operation, the first and second facing cooling fins separated by at least one open spacing dividing the lamp bulb into the first and second bulb half forming two discernable bulb parts, said first and said second bulb half each being substantially hemispherical and separated by the open spacing dividing the bulb into the first and second bulb halves;

a lamp axis extending along the insertion direction through a central end of the socket, through said open spacing, and through an imaginary central extreme of the bulb most remote from the socket, said first bulb half having a first PCB with the first light source, the first PCB mounted on the first cooling fin, the second bulb half having a second PCB with the light source, the second PCB mounted on the second cooling fin, each of the first and the second PCB separated by the open spacing, and each of the first and second bulb halves having a light redistributing, light transmittable wall for redistributing light originating from the light source in each respective bulb half so as to obtain a predefined light distribution during operation of the lamp.

2. The Electric lamp according to claim 1, wherein said wall comprises at least one feature chosen from the group consisting of:

a (remote) phosphor;

a reflective means;

a diffusing means;

a shape deviating essentially from a part of a sphere.

3. The Electric lamp according to claim 1, wherein said wall comprises at least two, non-integral separate wall parts.

4. Electric lamp according to claim 1, wherein said light transmittable wall is part of the lamp bulb.

5. Electric lamp according to claim 1, wherein said light transmittable wall is part of an inner bulb arranged inside the lamp bulb.

6. Electric lamp according to claim 1, wherein said light transmittable wall is part of the light source.

7. Electric lamp according to claim 1, wherein the light source is mounted on the respective PCB which is integral with the respective cooling fin.

8. Electric lamp according to claim 7, wherein each PCB together with a respective bulb part forms a respective discernable lamp bulb compartment.

9. Electric lamp according to claim 8, wherein in each bulb compartment at least one respective semiconductor light source is arranged.

10. Electric lamp according to claim 8, wherein the two discernable lamp bulb compartments are interconnected via at least one bridge which bridges the spacing.

11. Electric lamp according to claim 7, wherein the bulb parts are arranged so as to be mutually mirror symmetrical with respect to a plane P extending in between the PCBs.

12. Electric lamp according to claim 1, wherein the open spacing has a width in the range of 3 mm to 20 mm.

13. Electric lamp according to claim 1, wherein the lamp bulb essentially has a spherical shape.

14. Electric lamp according to claim 1, wherein each discernable bulb part is shaped as a surface of a half prolate ellipse having two equal radii and one deviating radius, the spacing extending through the two radii of the ellipse that are equal.

15. Electric lamp according to claim 1, wherein each discernable bulb part is shaped as a surface of a half oblate ellipse having two equal radii and one deviating radius, the spacing extending through the two radii of the ellipse that are equal.

* * * * *